US007380410B2

(12) United States Patent
Rand et al.

(10) Patent No.: US 7,380,410 B2
(45) Date of Patent: Jun. 3, 2008

(54) PULL-OUT ACCESS COOLER UNIT

(75) Inventors: Thomas W. Rand, Cedarburg, WI (US); Lawrence D. Moye, Kewaskum, WI (US); Andrew J. Doberstein, Hartford, WI (US); Jack L. Vaughn, Muskego, WI (US)

(73) Assignee: U-Line Corporation, Milwaukee, WI (US)

( * ) Notice: Subject to any disclaimer, the term of this patent is extended or adjusted under 35 U.S.C. 154(b) by 284 days.

(21) Appl. No.: 11/223,358

(22) Filed: Sep. 9, 2005

(65) Prior Publication Data

US 2006/0218958 A1 Oct. 5, 2006

Related U.S. Application Data

(60) Provisional application No. 60/667,148, filed on Mar. 31, 2005.

(51) Int. Cl.
*F25D 23/12* (2006.01)

(52) U.S. Cl. ..... 62/302; 62/382; 62/342; 312/301; 312/330.1; 312/402; 312/410

(58) Field of Classification Search ..... 62/302, 62/382, 442; 312/402, 404, 410, 301, 330.1
See application file for complete search history.

(56) References Cited

U.S. PATENT DOCUMENTS 2,425,232 A * 8/1947 Earle ..... 312/308
3,077,749 A * 2/1963 Jung et al. ..... 62/414
3,744,270 A * 7/1973 Wilcox ..... 62/344
4,317,607 A * 3/1982 Gomolka ..... 312/236
5,120,118 A * 6/1992 Rankin ..... 312/402
5,765,391 A * 6/1998 Lee et al. ..... 62/442
5,848,534 A * 12/1998 Stauffer ..... 62/91
7,197,888 B2 * 4/2007 LeClear et al. ..... 62/186

OTHER PUBLICATIONS

Sub-Zero Freezer Company, Inc. and Wolf Appliance Company, LLC, Sub-Zero 424 Undercounter, webpage from www.subzero.com, printed Apr. 12, 2006.

* cited by examiner

*Primary Examiner*—William E. Tapolcai
(74) *Attorney, Agent, or Firm*—Quarles & Brady LLP

(57) ABSTRACT

A wine cooler unit has a refrigerated cabinet housing two pull-out assemblies, each having a door panel and one or more wine racks. One rack can be mounted to the door panel, and one or more follower racks can be extended and retracted by movement of the door panel mounted rack, or by independent manual movement thereof. Two or more racks can be pulled out from the cabinet in a staggered or cascading fashion in which an upper rack extends from the cabinet to a lesser extent than a next lower rack to provide access to the bottles on each rack. The door panels can be made of a glass thermopane allowing visual inspection of the contents inside the cabinet. The cabinet can be cooled by a refrigeration system having two evaporators, which provide two independent cooling zones, one for each pull-out assembly. A capacitance-operated control can be provided under the glass front of one door panel for controlling the temperature zones inside the cabinet.

19 Claims, 12 Drawing Sheets

PULL-OUT ACCESS COOLER UNIT

CROSS-REFERENCE TO RELATED APPLICATIONS

This application claims the benefit of U.S. provisional application Ser. No. 60/667,148 filed Mar. 31, 2005.

STATEMENT OF FEDERALLY SPONSORED RESEARCH/DEVELOPMENT

Not applicable.

BACKGROUND OF THE INVENTION

1. Technical Field

The present invention relates to refrigerated storage units, and in particular, to compact refrigeration units in which the storage space is defined by one or more pull-out sections.

2. Description of the Related Art

Refrigerators and freezers for the cold storage of food and beverage items are well known. Many conventional units have one or more doors that are hinged to the front side of the cabinet. Food and beverages are ordinarily stored on shelves in the cabinet and the door(s) as well as in slide-out crisper drawers near the bottom of the cabinet.

Increasingly people are desiring more variety and design flexibility for cool storage space in kitchens, bars and other rooms. While the conventional full-sized stand-up refrigerators are still popular and used frequently, more and more small, compact cool storage units are being used. These compact units can be installed in areas, such as under counters or in an "island", where it is may be more convenient to access the items. Moreover, their small size also means that more units can be installed in a room. This has the added benefit of allowing for more-or-less item specific cooling in which a single unit, or part thereof, can be set to provide cooling and/or humidity conditions that are ideal for a particular food or beverage.

Examples of such dedicated use cool storage units can be found in the commercial offerings of U-Line Corporation, the assignee of the present invention, including its compact ice makers, beverage centers and wine coolers. These units have one or more temperature zones that can be controlled to suit the items being stored therein. For example, the beverage centers, commonly used to hold soda and beer, maintain about a 35° F. temperature, which is ideal for such beverages, while its wine storage units maintain an ideal 40-60° F. temperature range.

Some compact cool storage units are drawer units that have bins in which the food or drink is stored and cooled. Such pull-out drawer refrigerators have proven to be well-received by consumers due to the increased ability to access the stored items. Undercounter installations have the added benefit of being low and thus within reach of children and shorter adults. Often such drawer refrigerators have two, or possibly more, pull-out drawers that are arranged side by side or vertically stacked one above the other so that not all of the items are stored in the same drawer. By properly controlling the cooling source and/or air flow conditions inside the cabinet, it is possible to create distinct temperature zones within the same cabinet. Thus, a unit with multiple drawers can store multiple items requiring disparate cooling conditions. As an example of storing in a single unit complementary goods that require different cooling conditions, in one drawer of such a unit, wine can be stored in its ideal environment, and in another drawer, cheeses can be stored in an ideal environment for dairy products.

While the consumer cool storage industry has advanced significantly in recent years, improvements are still needed. For example, accessibility to the stored items remains an issue of concern. This is particularly true for wine storage units. As mentioned, drawer units improve accessibility to the stored items, however, their deep bins are meant to store items that are stacked upon each other or are individual upright standing items. Thus, it can be difficult at times for the consumer to remove an item or to detect which items are stored where in the cabinet. Often the consumer will have to open the drawer or the door and hunt around for the intended item.

Wine storage units have been devised with glass door panels that allow for visual inspection of the wine without opening the door. Some wine storage units also have one or more wine racks that can be slid out from the cabinet after the door is opened. Both of these things help the consumer select and retrieve the intended item or bottle of wine. The glass front door panel also allows the wine bottles to be displayed while being maintained at an ideal temperature. However, even these units have accessibility issues because generally each rack must be pulled out from the cabinet in order to see all of the bottles on a rack. Moreover, each rack must be pulled out and returned inside the cabinet one at a time so that, for example, a lower rack is not obscured by a higher rack.

Accordingly, a cool storage unit particularly suited for storing wine is desired that has improved accessibility features.

SUMMARY OF THE INVENTION

The present invention is a compact refrigeration unit for the cold storage of food and beverages, particularly bottled wine. The unit has one or more pull-out assemblies each with a door panel and a storage area for supporting the cooled items, e.g. wine bottles, and allowing them to be pulled out from the interior of the cabinet for easy access. Other features, such as a glass door front and cascading wine racks, can be also be provided to facilitate access and increase the user-friendliness of the unit.

Specifically, in one aspect, the invention provides a pull-out access wine cooler unit, which has a refrigerated cabinet where a pull-out assembly is mounted. The pull-out assembly has a door panel for closing a door opening in the cabinet in communication with the interior chamber and a rack mounted in the interior chamber so as to be movable by movement of the door panel to an extended position in which at least a portion of the rack extends through the door opening. The cabinet is cooled by a refrigeration system including an evaporator mounted within the interior chamber, a compressor receiving return refrigerant from the evaporator, and a condenser coupled to the compressor and to the evaporator through a restriction.

In one preferred form the cabinet is divided into two interior cavities and defining two door openings. The refrigeration system has two evaporators, one mounted within each cavity. The pull-out assemblies can each have a door panel for closing the associated door opening and a rack that is slidably received in the associated cavity. Preferably, the pull-out assemblies are arranged vertically one above the other.

In that the refrigeration system can have two evaporators, two temperature zones can be achieved inside the cabinet, one in each cavity. Preferably, an insulated partition divides the cabinet and essentially thermally isolates the two cavities from one another. The two temperature zones can be held at essentially the same temperature. Or, the two temperature zones can be maintained inside the cabinet such that different items can be stored at each pull-out assembly. For example, white wines can be stored on the racks of the lower pull-out assembly, which is disposed in a cooler temperature zone, such as 45° F., and red wines can be stored on the racks of the upper pull-out assembly, which is in a higher temperature zone, such as 60° F.

The refrigeration system can be controlled by a user control which is accessible from an outside of the cabinet for setting and adjusting the temperature zones. Preferably, the user control is one or more capacitive switches which are set behind a glass face panel of one of the door panels. The face panel can be part of a two-pane thermopane. The switch can be disposed inside of the thermopane or outside of the thermopane but behind an extending portion of the face panel. Either way, the capacitance switch allows for controlling the temperature inside the cabinet without opening either pull-out assembly (and thereby losing cooling). Also, the glass panel allows the inside of the cabinet to be visually inspected without opening either of the pull-out assemblies, and it also protects the switch from splashing (as when cleaning) or mechanical contact.

In another preferred form, one or more of the pull-out assemblies can have multiple vertically-spaced racks. At least one of the two racks in each pull-out assembly can be made to extend from the cabinet different distances simply by pulling the door panel away from the cabinet. In other words, these racks are mounted to move with the door panel and slide-out from the cabinet in a cascading fashion such that the lowest rack extends out from the cabinet farther than the rack vertically above it, which would extend out farther than the rack above it if there were three cascading racks, for example. This facilitates unobstructed access to each rack, especially the lower rack(s). The pull-out assembly can have two, three or more racks, of the same or differing sizes.

One of the racks can be mounted, or otherwise fixed with respect to the door panel and can interact with a follower rack that is movable with respect to the door panel to cause the follower rack to be extended when the door panel is pulled away from the cabinet. Preferably, a mechanism is mounted to the drive, (door panel mounted) rack engages a catch member of the follower rack. A follower rack can have its own mechanism to engage a catch of a subsequent follower rack in the event three or more cascading racks are to be provided. For simplicity, one cam and catch arrangement of only the drive and adjacent follower racks is described in detail.

In one preferred form, the mechanism includes a cam that is mounted to rotate about 90 degrees in both clockwise and counterclockwise directions between first and second positions. In the first position, an edge surface of the cam engages a back surface of the catch member to extend the follower rack, and in the second position, another edge surface of the cam is moved to face a front surface of the catch member. This permits the follower rack to be retracted manually by pushing the follower rack inward independent of the drive rack. In this case, with the follower rack fully retracted, when the drive rack is also fully retracted, the cam member will flip back to the first position by engagement with the cam member so that it is in position to extend the follower rack the next time the drive rack is pulled out. In another preferred form, when the cam member is in the second position the follower rack can be retracted in response to retraction of the drive rack. Specifically, another surface of the cam member can engage a front surface of the catch member to cause it to pull the follower rack along to the retracted position.

The cam is releasably held in each of the first and second positions by one or more detent arrangements, which preferably include a single spring tab with a projection parallel to the axis of rotation of the cam that is received in one of two pockets in the cam located to correspond to the first and second positions of the cam. The detent arrangement holds the cam in either position until the follower rack is fully extended or retracted, in which case the follower rack stops sliding and the force of engagement between the cam and catch members overcomes the force of the detent. The cam mechanism can be deactivated, that is, rendered inoperable from engaging the catch member sufficient to move the follower rack, by sufficiently increasing the rate at which the drive rack is extended or retracted.

In still another preferred form, one or more of the pull-out assemblies includes a storage compartment having an access opening at a lateral side of the pull-out assembly. The side-access compartment allows for space for storing a removable wine caddy.

These and still other advantages of the invention will be apparent from the detailed description and drawings. What follows are one or more preferred embodiments of the present invention. To assess the full scope of the invention, the claims should be looked to as no one embodiment is intended to fully set forth the scope of the invention.

DETAILED DESCRIPTION OF THE PREFERRED EMBODIMENT(S)

With reference to the figures, the present invention provides a cool storage unit 20 such as for food and beverages. The unit 20 includes an insulated cabinet 22 that is cooled by a refrigeration system 24 (see FIG. 11). The cabinet 22 houses one or more pull-out assemblies, such as pull-out assemblies 26 and 28, for supporting the stored items and allowing the items to be pulled out from the cabinet and accessed readily. In the preferred form discussed in detail herein, the unit 20 is a wine cooler unit for storing bottles of wine in a suitable, constant temperature environment. The cabinet holds the two pull-out assemblies 26 and 28 in a vertically stacked arrangement. While this is preferred, it should be noted that the cabinet 22 could hold only one pull-out assembly or more than two pull-out assemblies in a stacked or horizontal side-by-side arrangement. It should also be noted that the pull-out assemblies can include both racks and bin-like drawers.

Figure 1:
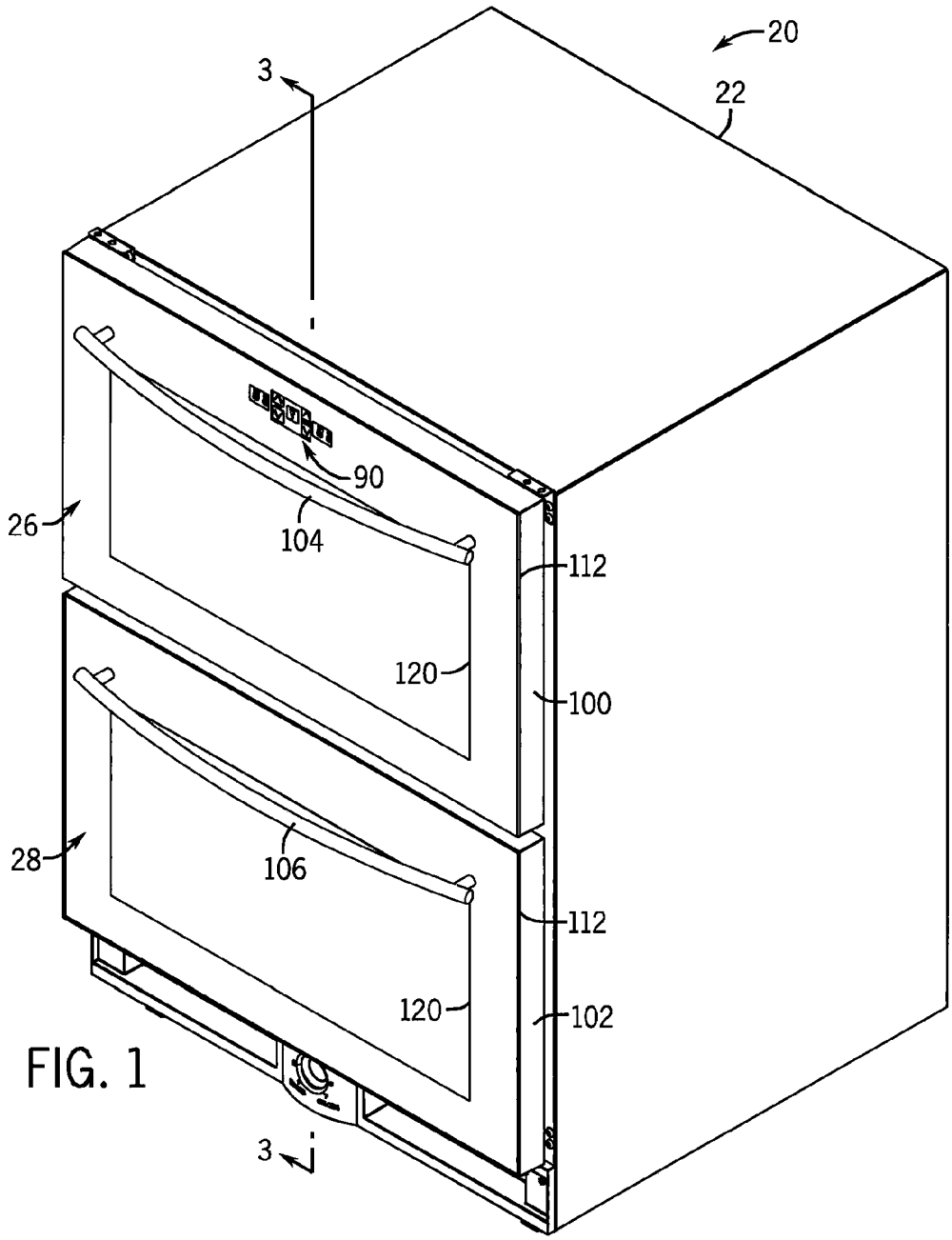
FIG. 1 is a perspective view of a pull-out access cool storage unit of the present invention.
Figure 2:
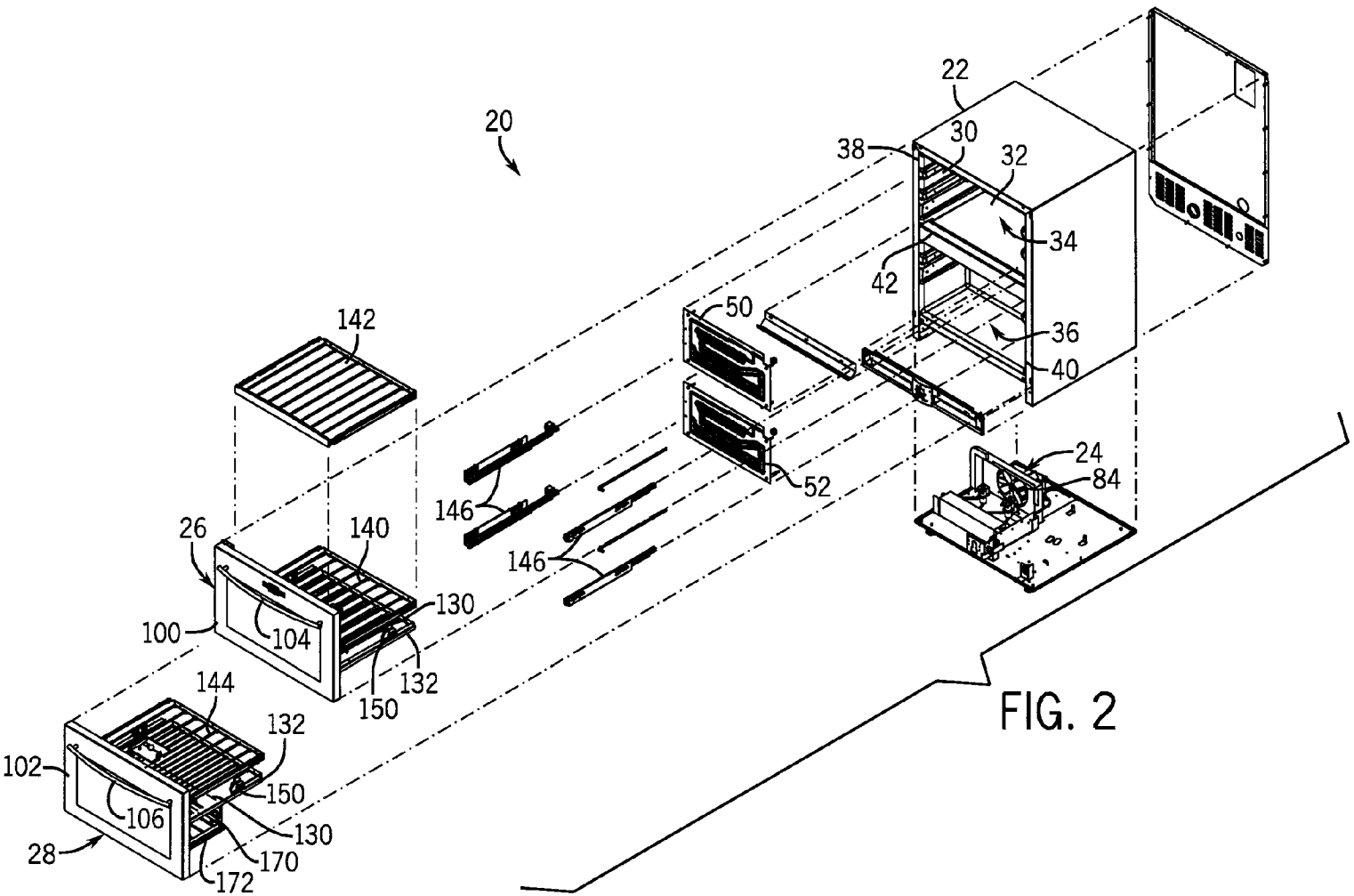
FIG. 2 is an exploded perspective view thereof.
Figure 3:
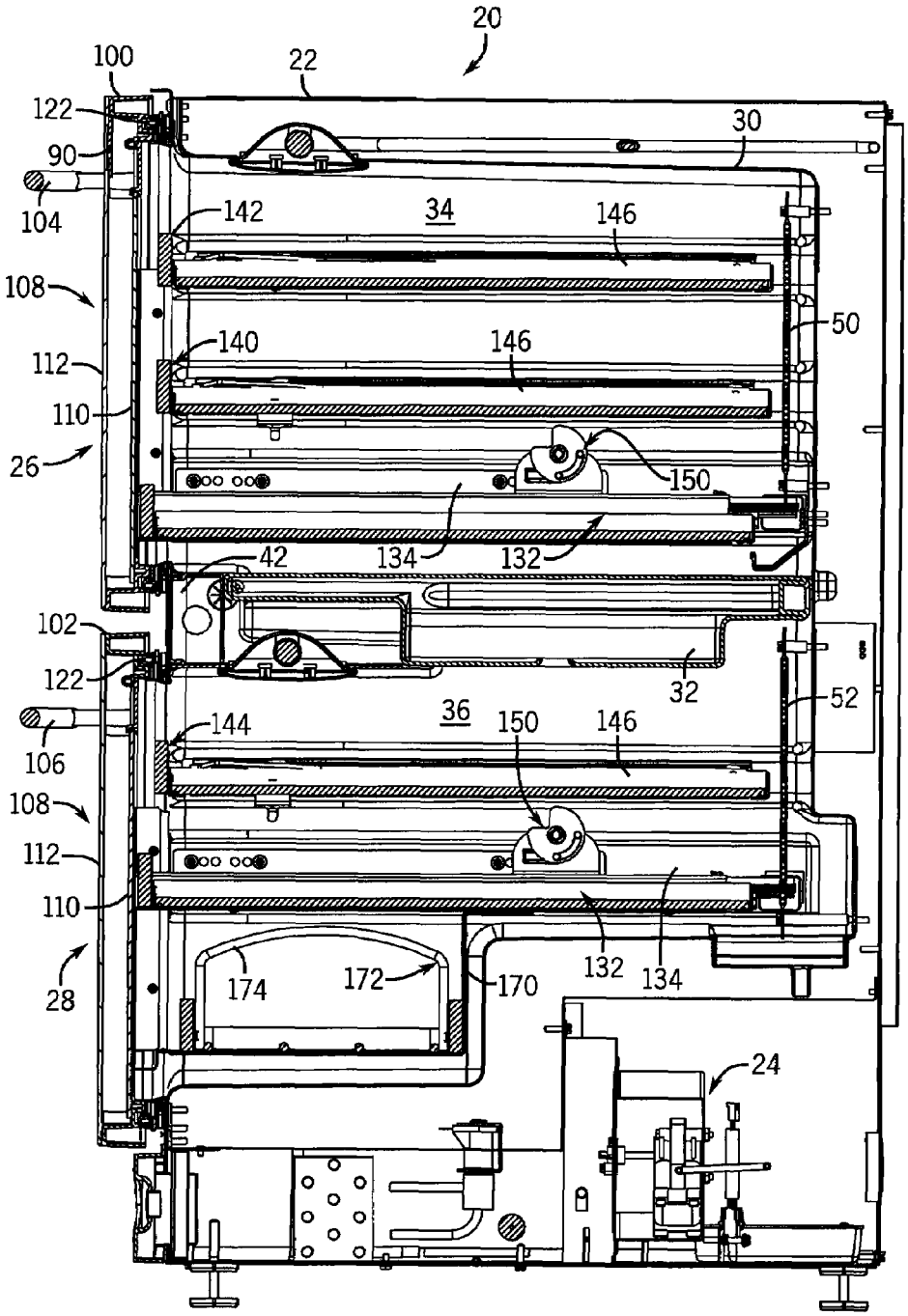
FIG. 3 is a side sectional view taken along line 3-3 of FIG. 1.

Referring to FIGS. 1-3, the cabinet 22 defines an internal chamber 30 divided vertically by a partition 32 into two vertically aligned cavities 34 and 36 in which are disposed the two pull-out assemblies 26 and 28, respectively. The cavities open to respective front openings 38 and 40. The cabinet 22 and the partition 32 are formed of inner and outer members of molded plastic or formed metal, with the space therebetween filled with foam insulation as known in the art. A mullion 42 extends across the front of the cabinet 22 to support the front edge of the partition 32, which is suitably supported at its side and back edges as well. The mullion 42 can be heated by a low wattage surface heater (not shown) to remove any condensation that may occur during operation.

Preferably, each cavity 34 and 36 has an independent temperature zone provided by the refrigeration system 24. The temperature zones can be controlled independently to be at the same or different temperatures to suit the items stored in the associated cavities, preferably each within a range of 40-60° F. for the wine cooler embodiment described herein. Although it may depend on the variety and other factors, red wines are typically best kept at about 60° F., white wines at about 50-55° F., and sparkling wines at about 45° F.

Figure 11:
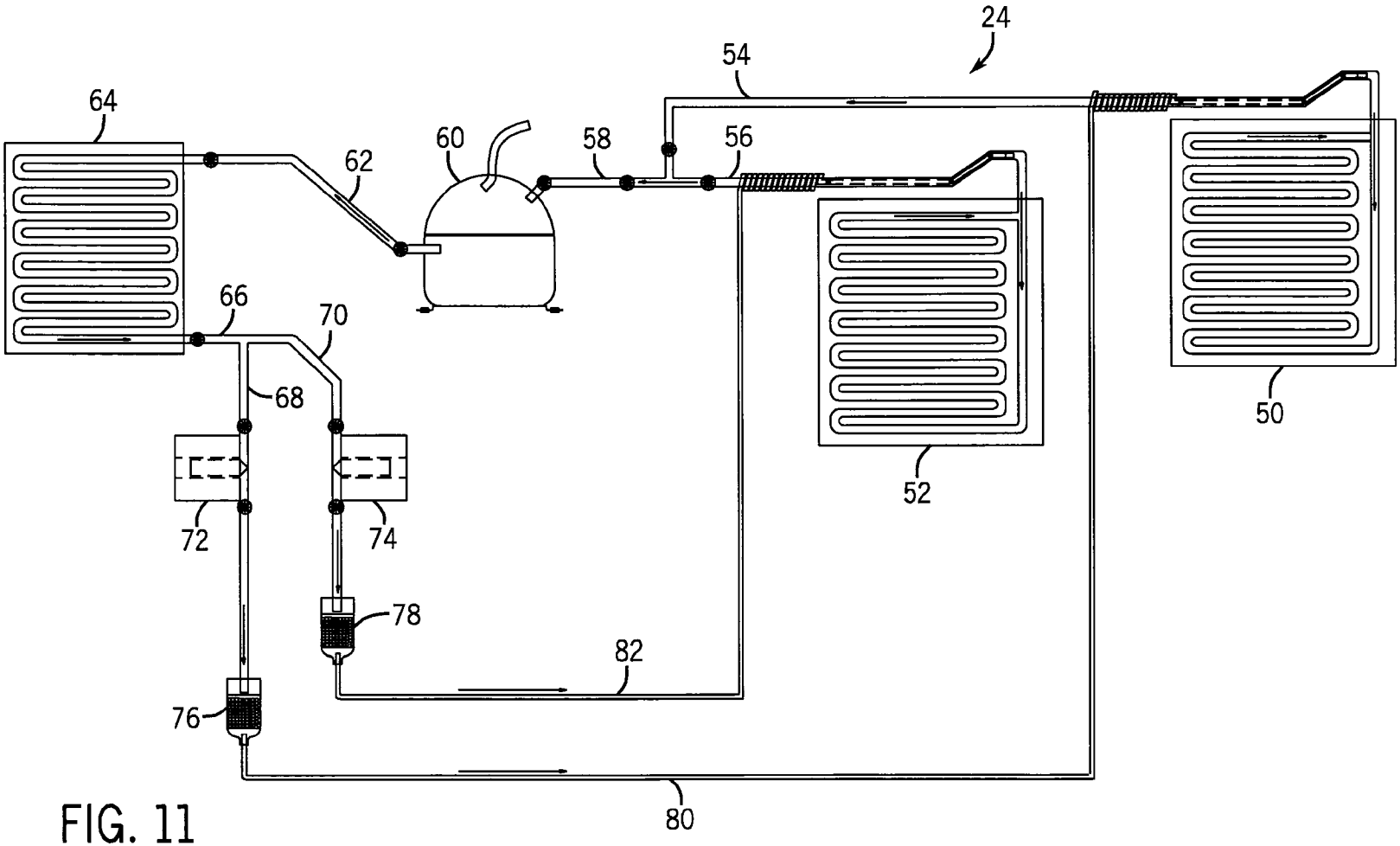
FIG. 11 is a schematic diagram of the refrigeration system.

With reference to FIGS. 2, 3, and 11, the refrigeration system 24 is largely located beneath and to the exterior of the interior chamber of the cabinet 22. However, the refrigeration system 24 has two evaporators 50 and 52 mounted to the back wall of the cabinet interior, one in each cavity 34 and 36, respectively. Shown schematically in FIG. 11, evaporators 50 and 52 each have an outlet line 54 and 56, which join with a common line 58 to pass gas refrigerant to a compressor 60. An output line 62 of the compressor 60 is connected to the inlet of a condenser 64 having an outlet line 66 which branches into two lines 68 and 70 having flow therethrough controlled by solenoid valves 72 and 74 and with dryers 76 and 78, respectively. Small diameter capillary tubes 80 and 82 lead from the respective dryers 76 and 78 to the inlets of the evaporators 50 and 52.

The compressor 60 draws refrigerant from one of the evaporators 50 and 52 and discharges the refrigerant under increased pressure and temperature to the condenser 64. The hot refrigerant gas entering the condenser 64 is cooled by a condenser fan 84 (see FIG. 2). As the temperature of the refrigerant drops under substantially constant pressure, the refrigerant in the condenser 64 liquefies. The restricted diameter of the associated capillary tube maintains the high pressure in the condenser 64 and at the compressor outlet while providing substantially reduced pressure in the associated evaporator. This reduced pressure results in a large temperature drop and subsequent absorption of heat by the evaporator. When the evaporator 50 is cooling cavity 34, the solenoid valve 74 closes off the line between the condenser 64 and the other evaporator 52, and vice versa. In this way, the refrigeration system 24 alternately cools each cavity 34 and 36.

Figure 9:
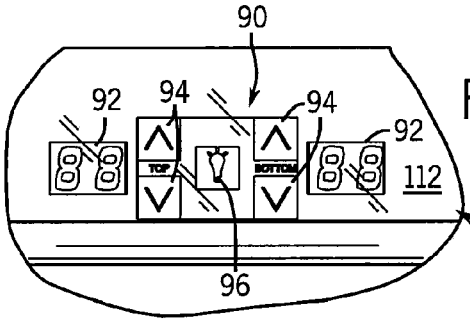
FIG. 9 is a enlarged view of a capacitance sensing user control for setting and controlling the temperature within the unit.

The refrigeration system 24 is electronically controlled to maintain the set temperature zones in the cavities 34 and 36 of the cabinet. A control unit (not shown) is mounted in the basement of the cabinet 22 outside of the cooled space. As shown in FIGS. 1 and 9, a user control 90 is used to interface with the control unit. The control 90 has two LED displays 92 and "temperature up" and "temperature down" switches (arrows) 94 for each temperature zone of cabinet cavity 34 and 36. A "light toggle" switch (light bulb) 96 is also provided for controlling the light in each cavity 34 and 36. The LED displays 92 provide actual and set temperature readings in each zone. The control 90 is used to set the desired temperature for each zone after which the control unit cycles the refrigeration system to maintain the set temperatures within a prescribed temperature variance from the set temperature. The switches are capacitance sensing switches such that no mechanical motion is necessary to trip the contact. Each switch senses the presence of the user's finger by detecting a change in capacitance or a threshold capacitance value at the switch location. This allows the switches to be placed behind a panel, such as a glass front panel discussed below. This protects the switches from debris and splashing and gives the unit a clean, sophisticated look.

Figure 8:
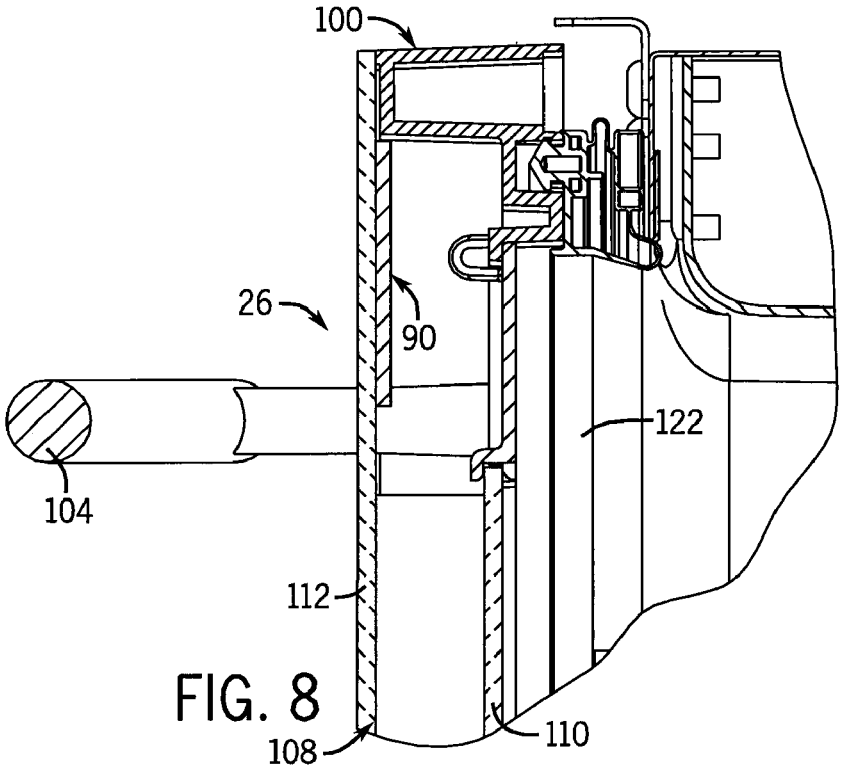
FIG. 8 is an enlarged partial sectional view taken along line 3-3 of FIG. 1.

Referring now to FIGS. 2-6 and 8, each of the pull-out assemblies 26 and 28 has a front door panel 100 and 102 with a handle 104 and 106, respectively. The door panels 100 and 102 each have a glass thermopane 108 having a rear panel 110 spaced from and sealed to a face panel 112. The thermopane 108 insulates the door panels and allows visual access inside the cabinet 22 through an actual window area 120. The border around the window area 120 is darkened to reduce light exposure inside the cabinet 22, which could otherwise be harmful to certain wines. As shown in FIG. 8, the face panel 112 extends flush with the edges of each door panel and is larger than the rear panel 110. As mentioned, the user control 90 is built into the door panel 100 behind the top part of the face panel 112 and above the thermopane 120. A refrigerator seal 122 is mounted at the inside perimeter of each door panel to seal with the face of the cabinet 22.

Fixed to each door panel 100 and 102 is a bottom rack 130. Each bottom rack 130 is mounted to the interior of the cabinet 22 in its respective cavity 34 and 36 by a pair of three-piece full-extension slides 132, each having an inner member 134 fixed to the cabinet 22, an outer member 136 fixed to the door panel and the rack 130, and an intermediate member 138 slidable within the inner 134 and outer 136 members. The full-extension slides 132 permit the bottom rack 130 to be extended entirely out of the cabinet 22 by pulling the associated door panel away from the cabinet 22. Small tabs (not shown) on the inner 134 and outer 136 members act as stops to prevent the pull-out assemblies 26 and 28 from being pulled free of the cabinet 22.

The upper pull-out assembly 26 has three racks including a middle rack 140 and an upper rack 142. The lower pull-out assembly 28 has only one additional upper rack 144. Each rack has a contoured wood front and vinyl coated steel bars. Racks 140, 142 and 144 are mounted by pairs of two-piece slides 146 to the cabinet interior with vertical spacing from adjacent racks. The upper rack 142 is slid out from the cabinet 22 by hand and is completely independent of the other racks. This rack can be used for wine that is intended to be kept stationary until it is to be consumed.

Figure 7:
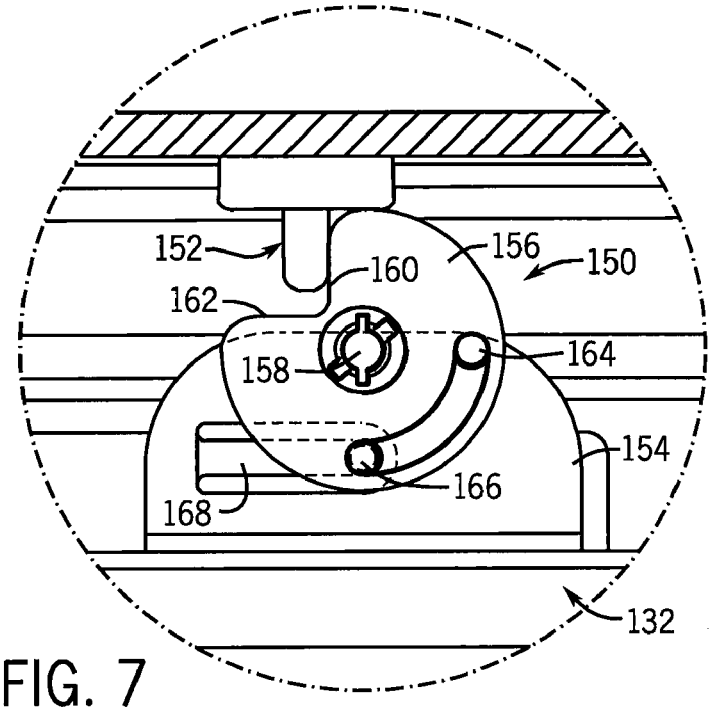
FIG. 7 is an enlarged partial side view taken at arc 7-7 of FIG. 4 showing a cam mechanism.

The middle rack 140 in the upper cavity and the upper rack 144 in the lower cavity are each linked to the associated bottom rack 130 such that they can be extended along with the bottom rack 130 simply by pulling outward on the handle of the door panel. These follower racks are linked by a pair of cam mechanisms 150 mounted to each bottom rack 130 at about the rear ⅓ of the rack and a pair of downwardly depending catch members 152 mounted to each of the middle rack 140 and the upper rack 144 at about the front ¼ of the racks. As shown in FIG. 7, each cam mechanism 150 includes a mounting bracket 154 to which a cam disk 156 is rotatably mounted on an axle 158. The cam disk 156 has a right-angle notch defining two perpendicular edge surfaces 160 and 162. It also includes a detent arrangement with a pair of indented recesses 164 and 166, which receive an axial projection (not shown) at the free end of a spring tab 168 formed in the bracket 154.

Figure 4:
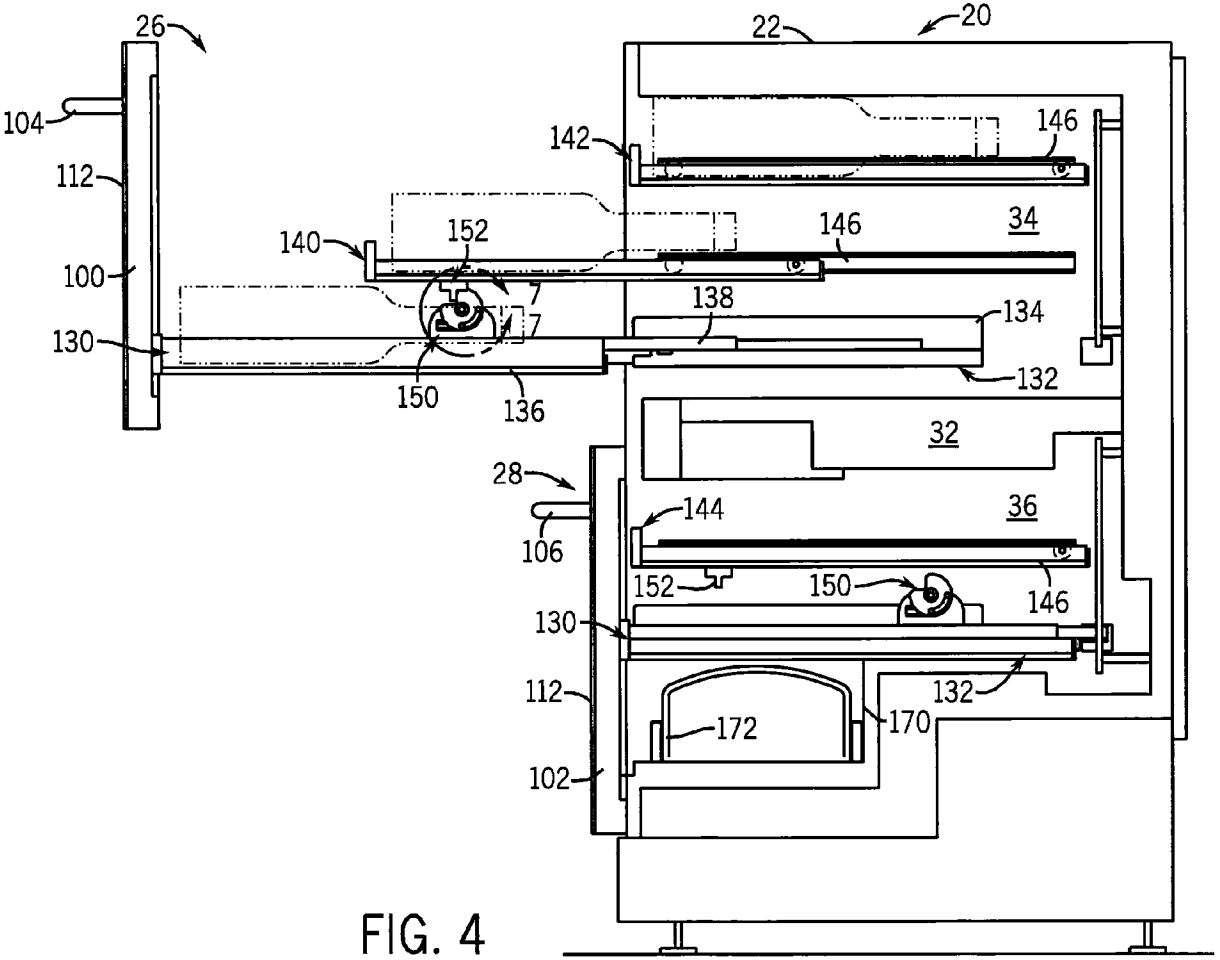
FIG. 4 is a simplified side view showing an upper pull-out assembly partially extended from the cabinet.
Figure 5:
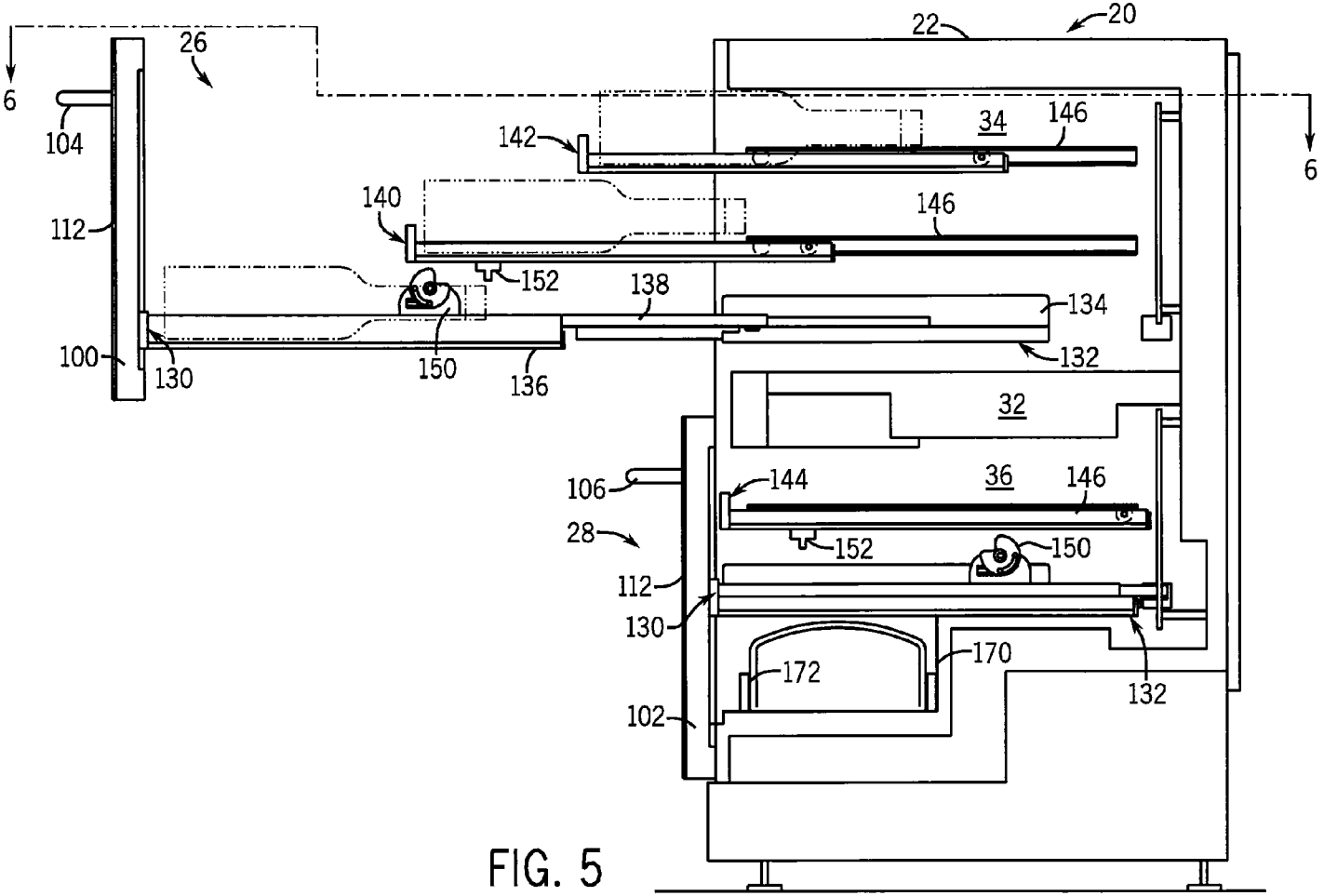
FIG. 5 is a similar side view showing the upper pull-out assembly fully extended with an uppermost rack partially extended such that the racks form a cascading arrangement in which bottles on each rack are visible and accessible.
Figure 6:
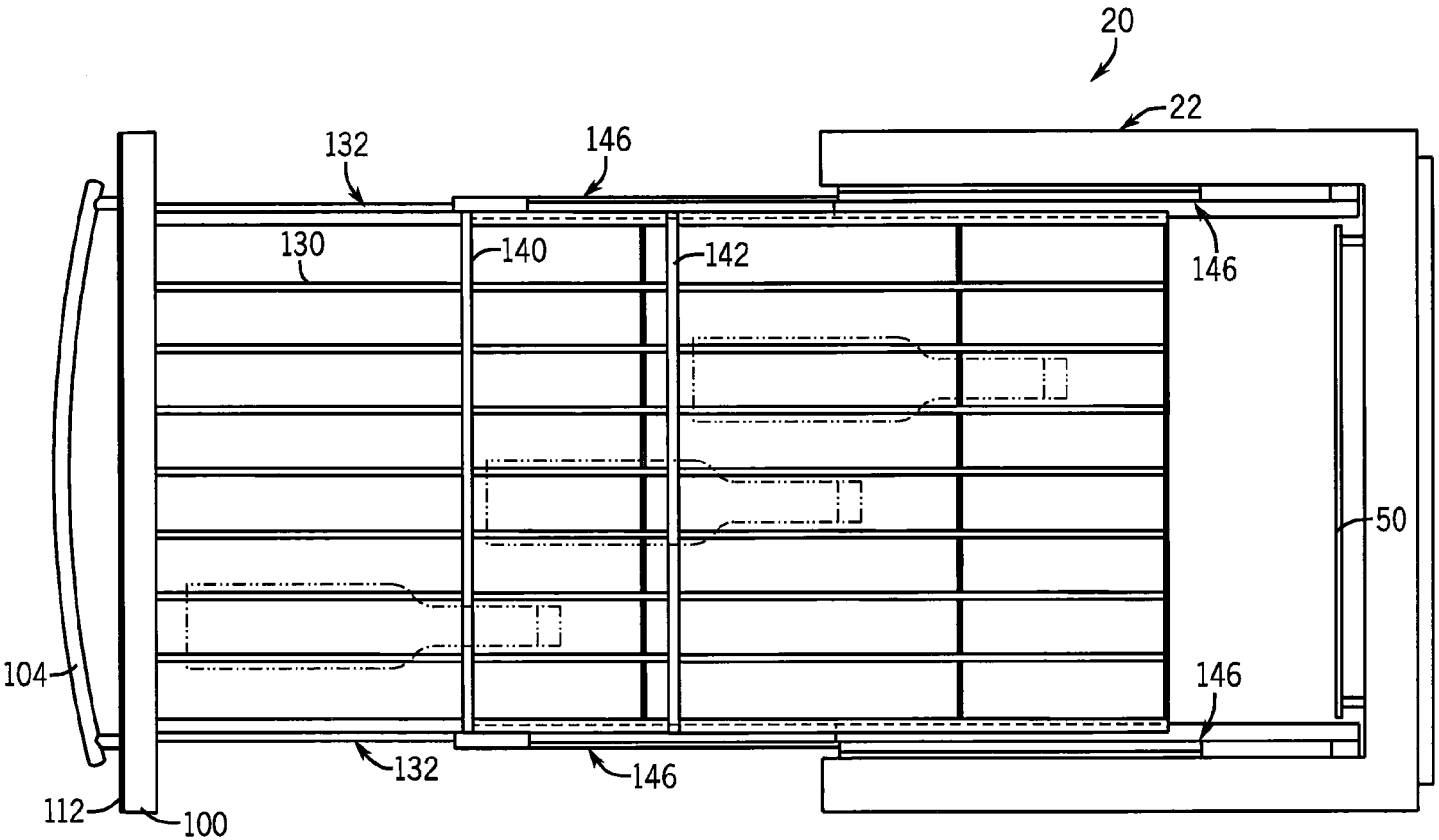
FIG. 6 is a simplified top view taken along line 6-6 of FIG. 5.

As shown in FIGS. 3-5, when the pull-out assemblies are fully retracted so that the door panel seals are seated against the front face of the cabinet 22, the cam disks 156 are held in a first orientation (shown in FIG. 3) by engagement of the spring tabs 168 with the recesses 164. As the door panel is pulled away from the cabinet far enough (as shown in FIGS. 4 and 7), edge surfaces 160 of the cam disks abut the back sides of the catch members 152. The engagement of the spring tabs 168 and recesses 164 provide sufficient force to hold the cam disks 156 in the first position and drive the middle 140 and upper 144 racks to an extended position. When they are fully extended, internal stops of the slides resist further movement of the racks 140 and 144. This overcomes the force of the detent arrangements such that the spring tabs 168 disengage from the recesses 164 to allow the cam disks 156 to rotate clockwise, which permits the bottom racks to continue to be extended to their fully extended position (as shown in FIG. 5). The cam disks 156 rotate until the spring tabs 168 engage recesses 166 to hold the cam disks 156 in a second orientation (as shown in FIG. 5). When in this orientation and the door panel is pushed inwardly, the edge surfaces 162 will abut the front sides of the catch surfaces 152 and push the racks inward until stopped by their slides after which the cam disks 156 will rotate counter-clockwise and return to the first orientation. The bottom racks are thus allowed to fully retract into the cabinet. The cam mechanisms thus engage the catch members only through the range of travel of the racks 140 and 144, disengaging them both before and after so as to fully extend and retract the bottom racks. The locations of the cam mechanisms and catch members are selected so that the bottom racks extend farther out from the cabinet than the racks 140 and 144. This staggered or cascading arrangement allows the label ends of the bottles of each rack to be viewed, and the bottles accessed, without obstruction from the other racks. In the case of the upper pull-out assembly 26, the independent upper rack 142 can be partially extended to reveal the bottle labels and allow access to the bottles so it, too, aligns in a cascading manner with the lower two racks, as shown in FIGS. 5 and 6. Closing the door panel 100 will push the upper rack 142, and racks 130 and 140, back to their retracted positions.

It should be recognized that the construction of the described cam mechanisms allows for selective linking of the bottom racks with the adjacent racks. The cam disks 156 will engage the catch members, and thereby move the follower racks, only when in the first or second orientation. The cam disks 156 are held in these positions only by the engagement of the spring tabs 168 in either recesses 162 or 164. If the force of engagement with the follower racks is greater than the force of the detents, then the cam mechanisms will effectively be disengaged. This can be achieved by pulling the pull-out assemblies from the cabinet (or pushing them inward) more rapidly such that there is an elevated force at the interface of the cam disks with the catch surfaces, which in turn causes the spring tabs 168 to pop out of the recesses and the cam disks to rotate rather than drive the catch members. By pulling or pushing the pull-out assemblies at an even, steady rate, the force at the cam/catch interface will diminish to less than the force at the detents, and thus permit the follower racks to be driven by the bottom racks, as described above.

Figure 12:
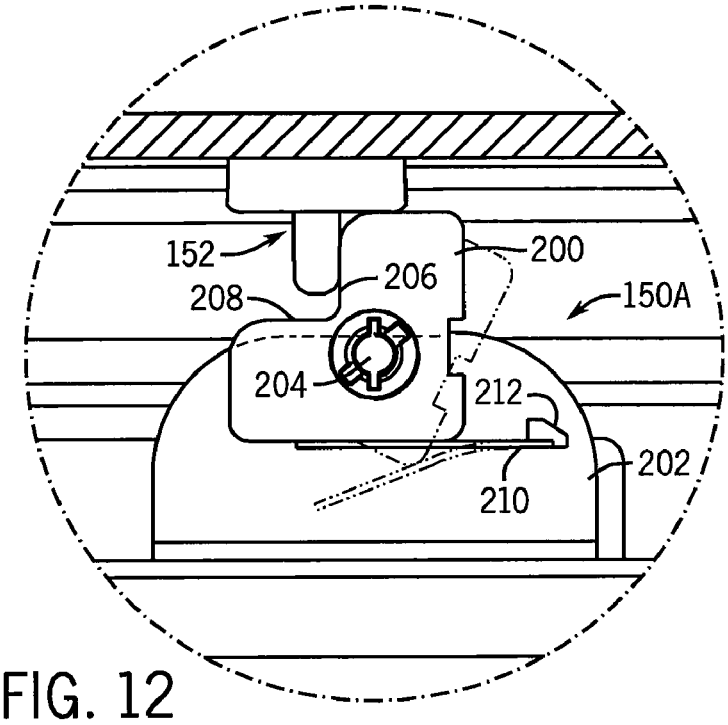
FIGS. 12 and 13 show an alternate version of the cam mechanism.
Figure 13:
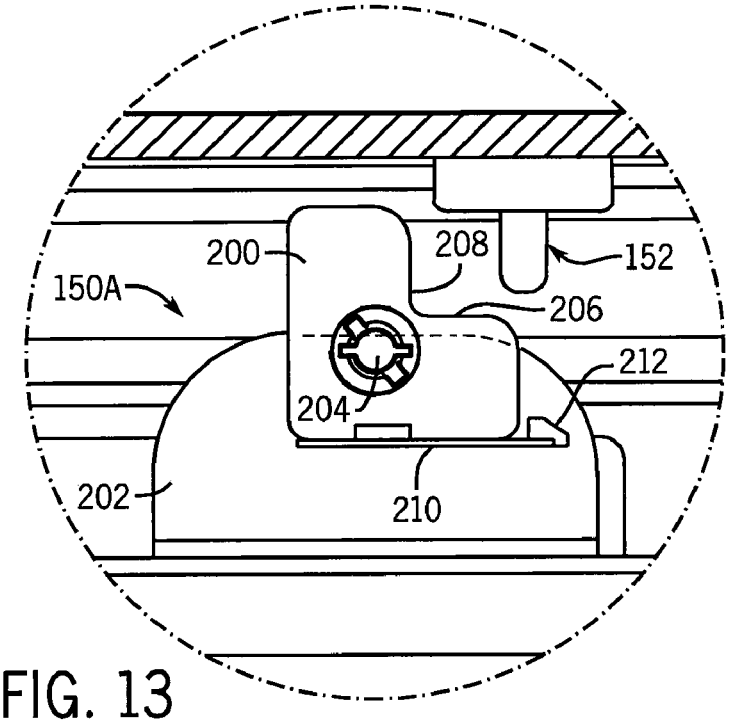

As shown in FIGS. 12 and 13, each cam mechanism 150A can have an L-shaped cam 200 that is rotatably mounted to a mounting bracket 202 via axle 204. The L-shape of the cam defines two edge surfaces 206 and 208 for contacting the respective back and front sides of the catch member 152 when the cam 200 is in the first orientation (shown in FIG. 12) for pulling out the follower racks and in the second orientation (shown in FIG. 13) for pushing the follower racks back inside the cabinet. The cam 200 is held in each of the orientations by a long leaf type spring member 210 that mounts to the bracket 202 at a recess 212. The spring 210 has a free end and extends along the lower edge of cam 200 such that it resists rotation of the cam 200 until sufficient force is applied, as when the bottom rack is pulled out past the fully extended position of a follower rack, in which case the cam 200 turns and deflects the spring 210 downward until the corner diagonal from the notched corner clears the spring 210. The spring than returns to its resting position.

This version of the cam mechanism mounts to opposite sides of each bottom rack as described above and works similarly to push and pull the follower racks in and out of the cabinet. The cam 200 rotates about 90 degrees between the first and second orientations after moving the follower racks to their fully extended or retracted positions and passing by the catch members. This cam mechanism 150A provides the same selective disengagement advantage described above.

Figure 14:
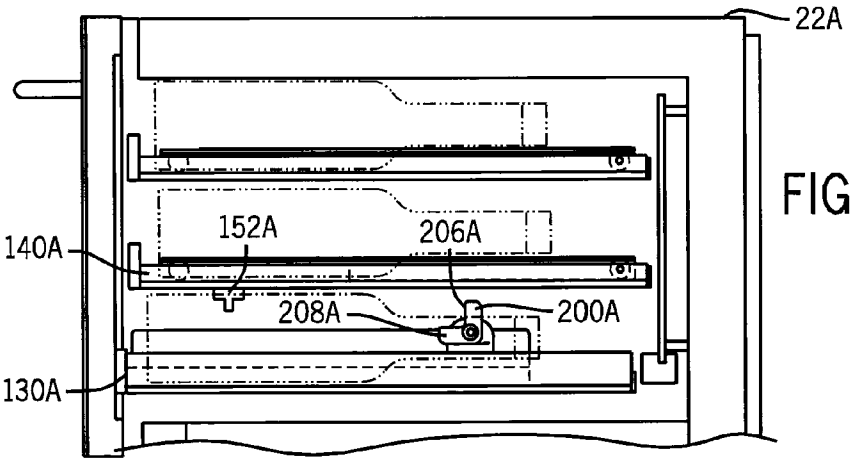
FIGS. 14-17 illustrate another preferred way of practicing the cascading cam sliding rack arrangement.
Figure 15:
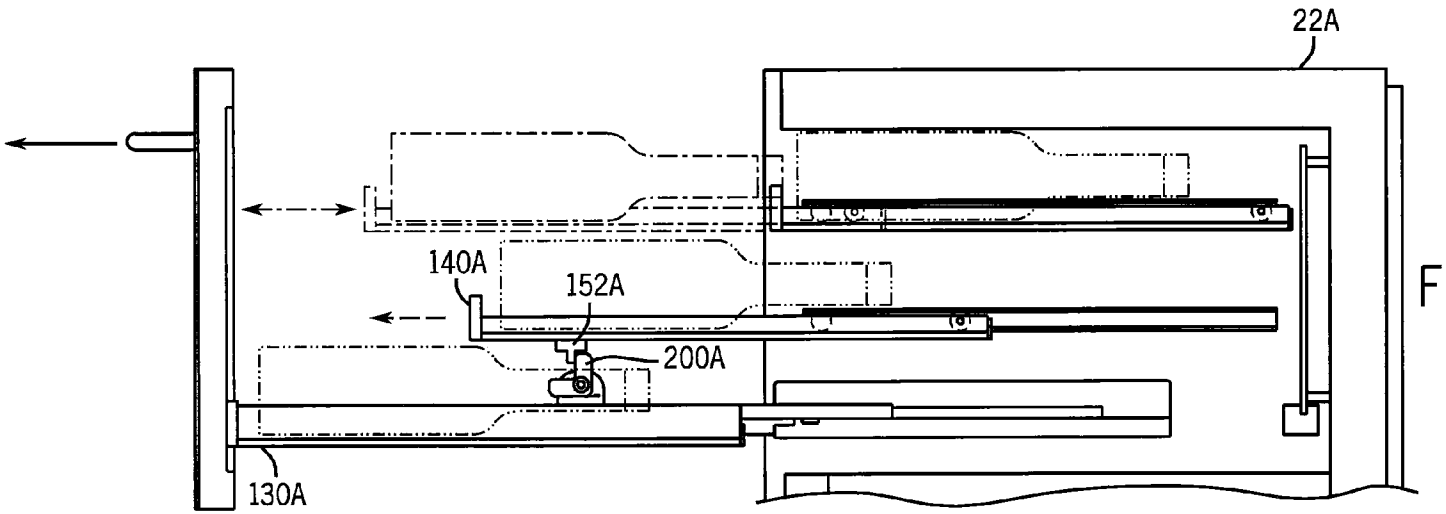
Figure 16:
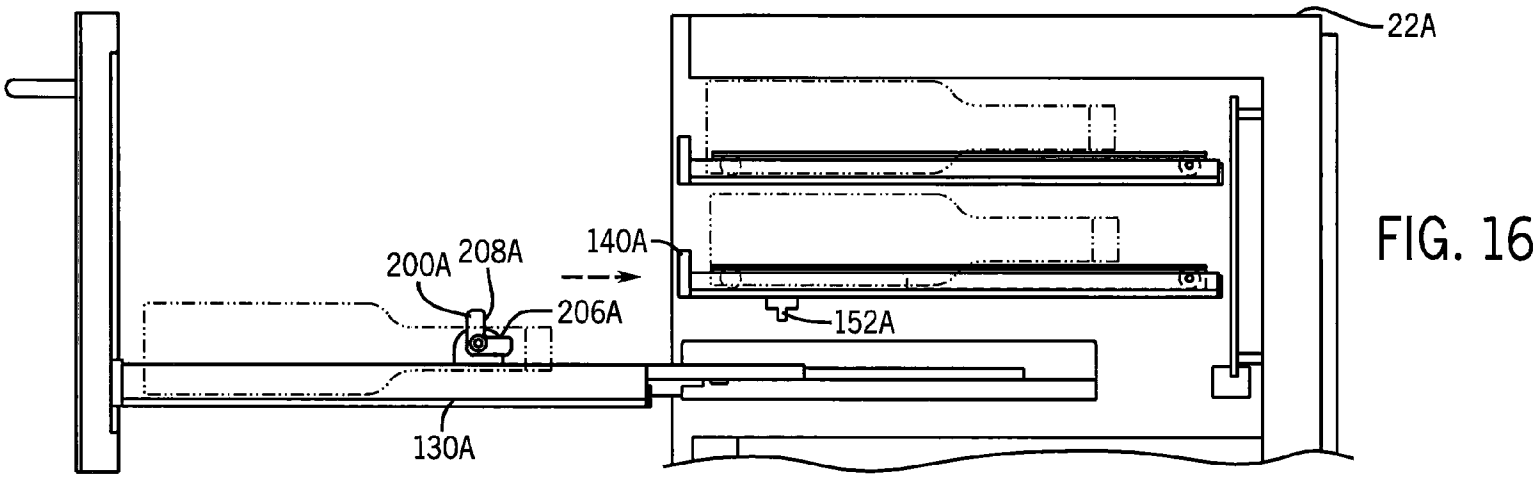
Figure 17:
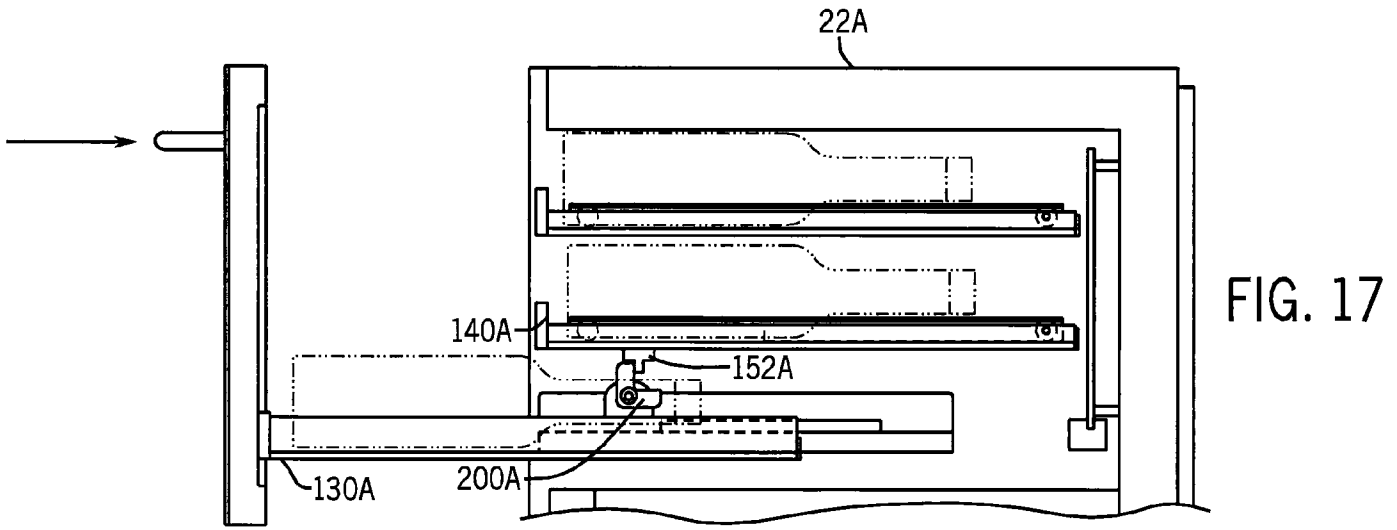

FIGS. 14-17 illustrate another way of utilizing the cam and catch members described above to provide cascading racks. Here, the drive rack 130A is used only to extend the follower rack 140A not to retract it. By engagement of the first face surface 206A of the cam 200A with the back (rear facing side) of the catch 152A when the cam is in the first position as shown in FIG. 14, the drive rack 130A will extend the follower rack 140A as the drive rack 130A is pulled from the cabinet 22A. When in the position shown in FIG. 15, the drive rack 130A is fully extended and the follower rack 140A is extended about half way. To access the back of the follower rack 140A, it can be pulled out to its fully extended position. And, if desired, the drive rack 130A can be partially retracted. Both of these movements can be performed without the cam 200A being counter rotated. For better access to the back of the drive rack 130A, the follower rack 140A can be retracted manually to the position shown in FIG. 16. As shown, doing this will rotate the cam 200A clockwise into its second position by engagement of the first face surface 206A of the cam 200A with the back side of the catch member 152A. As shown in FIG. 17, as the drive rack 130A is retracted the cam 200A will be returned automatically to its initial position by engagement of the second face surface 208A of the cam 200A with a front side (facing the cabinet opening) of the catch 152A. Thus, in the fully retracted position, the drive rack 130A is reset and ready to extend the follower rack 140A the next time the drive rack 130A is pulled out.

As shown in FIGS. 2-5, the lower pull-out assembly 28 also has a side-access compartment 170 that opens to its lateral sides. The compartment 170 holds a wine caddy 172. The wine caddy 172 has a rack bottom and arched handles 174 for carrying. The wine caddy 172 can hold three conventional wine bottles and can be slid out of the compartment from either side opening.

Figure 10:
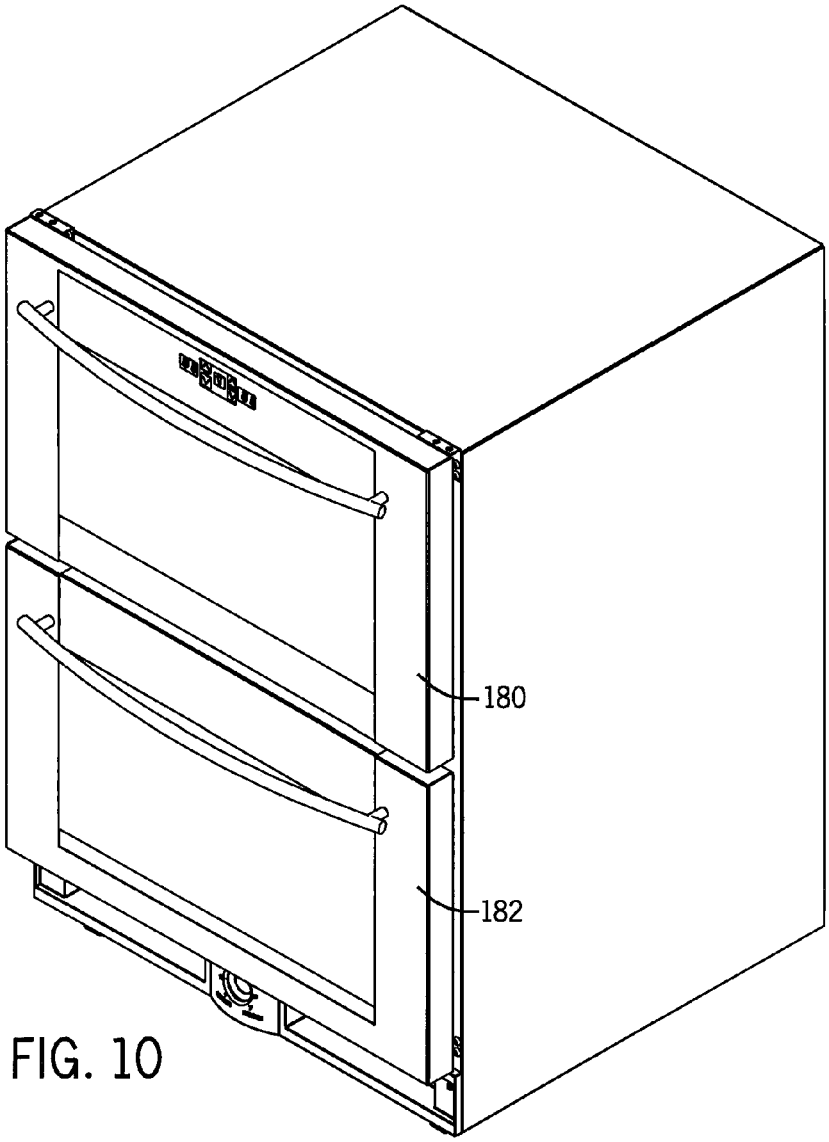
FIG. 10 is a perspective view of the cooler unit with door panel wraps.

FIG. 10 shows an additional feature of the unit of the present invention in which the door panels have wraps 180 and 182 mounted over the glass panels. The wraps can be made to match the cabinet exterior or cabinetry surrounding the unit. As one example, the wraps can be stainless steel to match a stainless steel cabinet of the cooler and stainless steel kitchen appliances.

It should be appreciated that merely one or more preferred embodiments of the invention have been described above. However, many modifications and variations to the preferred embodiment(s) will be apparent to those skilled in the art, which will be within the spirit and scope of the invention. Therefore, the invention should not be limited to the described embodiment(s). To ascertain the full scope of the invention, the following claims should be referenced.

We claim:

1. A pull-out access wine cooler unit, comprising:

a cabinet defining an interior chamber;

a refrigeration system including an evaporator mounted within the interior chamber, a compressor receiving return refrigerant from the evaporator and a condenser coupled to the compressor and to the evaporator through a restriction; and a pull-out assembly including a door panel for closing a door opening in the cabinet in communication with the interior chamber and including a rack mounted in the interior chamber so as to be movable by movement of the door panel to an extended position in which at least a portion of the rack extends through the door opening, wherein the pull-out assembly includes multiple vertically spaced racks in which one of the racks is fixed with respect to the door panel and has a mechanism that interacts with a follower rack that is movable with respect to the door panel to cause the follower rack to be extended when the door panel is pulled away from the cabinet.

2. The unit of claim 1, wherein at least two racks are caused to extend from the cabinet different distances by pulling the door panel away from the cabinet.

3. The unit of claim 1, wherein the mechanism includes a cam that engages a catch member of the follower rack.

4. The unit of claim 3, wherein the cam member is rotatably mounted.

5. The unit of claim 3, wherein the cam member is rotatable between first and second positions, in the first position the cam member engaging the catch member to extend the follower rack.

6. The unit of claim 5, wherein in the second position the cam member allows for retraction of the follower rack.

7. The unit of claim 6, wherein when the cam member is in the second position, the follower rack can be retracted by one of (a) manual retraction of the follower rack independent of the drive rack and (b) by engagement of the cam member with the catch member and retraction of the drive rack.

8. The unit of claim 5, wherein the cam member is releasably held in each of the first and second positions by one or more detents.

9. The unit of claim 1, wherein the door panel has a front face made of a glass panel.

10. The unit of claim 1, further comprising a second pull-out assembly with a door panel and a rack, wherein the second pull-out assembly is mounted at a second door opening in the cabinet.

11. The unit of claim 5, wherein the pull-out assemblies are positioned vertically one above the other.

12. The unit of claim 5, wherein the second pull-out assembly includes multiple vertically spaced racks.

13. A pull-out access wine cooler unit, comprising:

a cabinet defining an interior chamber;

a refrigeration system including an evaporator mounted within the interior chamber, a compressor receiving return refrigerant from the evaporator and a condenser coupled to the compressor and to the evaporator through a restriction; and a pull-out assembly including a door panel for closing a door opening in the cabinet in communication with the interior chamber and including a rack mounted in the interior chamber so as to be movable by movement of the door panel to an extended position in which at least a portion of the rack extends through the door opening, wherein the pull-out assembly includes a storage compartment having an access opening at a lateral side of the pull-out assembly and a wine caddy removably stowed in the storage compartment.

14. The unit of claim 1, further including a second pull-out assembly and wherein the cabinet defines two cavities within the interior chamber receiving the two pull-out assemblies and wherein the refrigeration system includes two evaporators, one disposed in each cavity such that there are two temperature zones one located in each cavity.

15. A pull-out access wine cooler unit, comprising:

a cabinet defining an interior chamber;

a refrigeration system including an evaporator mounted within the interior chamber, a compressor receiving return refrigerant from the evaporator and a condenser coupled to the compressor and to the evaporator through a restriction;

a pull-out assembly including a door panel for closing a door opening in the cabinet in communication with the interior chamber and including a rack mounted in the interior chamber so as to be movable by movement of the door panel to an extended position in which at least a portion of the rack extends through the door opening; and a user control accessible from an outside of the cabinet for controlling the refrigeration system, wherein the user control is a capacitive switch disposed behind a glass panel of the door panel.

16. The unit of claim 15, wherein the glass panel is part of a thermopane window defining the face of the door panel.

17. A pull-out wine cooler unit, comprising:

a cabinet having a divided interior defining first and second interior cavities and first and second door openings;

a refrigeration system including at least one evaporator mounted within the cabinet interior, a compressor receiving return refrigerant from the evaporator and a condenser coupled to the compressor and to the evaporator through a restriction;

first and second pull-out assemblies each including a door panel having a glass panel front face for closing the associated door opening and including a drive rack fixed to its door panel and a follower rack moved by engagement with the drive rack, the racks of each assembly being slideably received in the associated cavity such that at least a portion of the racks can be pulled out through the associated door opening; and a user control accessible from an outside of the cabinet for controlling the refrigeration system, wherein the user control is a capacitive switch disposed behind the glass panel of one of the door panels.

18. The unit of claim 17, wherein the first and second pull-out assemblies each include multiple vertically spaced racks.

19. A pull-out access cooler unit, comprising:

a divided cabinet defining first and second interior cavities and first and second door openings;

a refrigeration system including first and second evaporators mounted within the respective first and second cavities, a compressor receiving return refrigerant from the evaporators and a condenser coupled to the compressor and to the evaporators through a restriction;

first and second pull-out assemblies each including a door panel for closing the associated door opening and including a storage area connected to the door panel and movably received in the associated cavity such that at least a portion of the storage area can be pulled out through the associated door opening; and a user control accessible from an outside of the cabinet for controlling the refrigeration system, wherein the user control is a capacitive switch disposed behind a glass panel of the door panel of one of the first and second pull-out assemblies.

* * * * *